US007169001B2

(12) United States Patent
Higginbotham et al.

(10) Patent No.: US 7,169,001 B2
(45) Date of Patent: Jan. 30, 2007

(54) LIFE JACKET

(75) Inventors: Paul Higginbotham, Richmond (CA); Ping Yin Sheu, Delta (CA)

(73) Assignee: Mustang Survival Corp., Richmond (CA)

( * ) Notice: Subject to any disclaimer, the term of this patent is extended or adjusted under 35 U.S.C. 154(b) by 0 days.

(21) Appl. No.: 10/694,744

(22) Filed: Oct. 29, 2003

(65) Prior Publication Data

US 2005/0277346 A1 Dec. 15, 2005

(51) Int. Cl.
*B63C 9/08* (2006.01)

(52) U.S. Cl. ..... 441/112; 441/119

(58) Field of Classification Search ..... 441/106, 441/112–119

See application file for complete search history.

(56) References Cited

U.S. PATENT DOCUMENTS 278,240 A * 5/1883 Hunt ..... 441/113
1,511,006 A * 10/1924 Prescott ..... 441/117
2,950,488 A * 8/1960 Sabo ..... 441/116
3,570,030 A * 3/1971 Baker ..... 441/116
4,167,051 A * 9/1979 Galecke ..... 441/117
4,263,686 A * 4/1981 Jarvis, Jr. ..... 441/116
4,498,882 A * 2/1985 Evert ..... 441/116
5,759,076 A * 6/1998 Bateman et al. ..... 441/115
6,905,383 B1 * 6/2005 Daggs ..... 441/118

FOREIGN PATENT DOCUMENTS

GB 2 089 736 6/1982
GB 2264903 9/1993

* cited by examiner

*Primary Examiner*—Jesús D. Sotelo
(74) *Attorney, Agent, or Firm*—C. A. Rowley

(57) ABSTRACT

A buoyancy device has a rear buoyancy area interconnected to a pair of lateral under arm buoyancy areas by a pair of front buoyancy areas, and combining to form a simulated W-shape when viewed in a plan view. The provision of the lateral or underarm buoyancy areas function to hold the user more upright and normally higher above the level of the water when in use.

3 Claims, 10 Drawing Sheets

LIFE JACKET

FIELD OF INVENTION

This invention relates to life jackets particularly those incorporating one or more buoyancy chambers.

BACKGROUND OF THE PRESENT INVENTION

Traditionally, in life jackets provided with one or more buoyancy chambers for supporting the body, the buoyancy chambers are in the form of a collar that wraps around the neck of the user in a horse shoe type configuration that locates the majority of the buoyancy in front of the torso. Attention is directed to United Kingdom patents GB 2,264,903 issued Sep. 15, 1993 to Anthony Male of ML Lifeguard Equipment Ltd and GB 2,089,736 issued Jun. 30, 1982 to Rex Stanley Smith of Lifeguard Equipment Ltd which show examples of such construction.

These known lifejackets have a number of disadvantages. The main buoyancy chambers being located in front of the chest tend to cause the wearer to float in a backwards-leaning position with much of the buoyancy of the inflatable bladder above the surface of the water. This position typically provides little vertical displacement of the mouth and nose above the surface of the water (freeboard) leaving the wearer susceptible to ingestion of water splashed into the mouth by waves and wind which could lead to drowning, especially when unconscious.

BRIEF DESCRIPTION OF THE PRESENT INVENTION

It is an object of the present invention to provide an improved life jacket wherein the user is held in a safer position in the water Broadly the present invention relates to a buoyancy device comprising a central portion for forming a rear buoyancy area interconnected to a pair of lateral portions each forming an under arm buoyancy area by a pair of front portion forming front buoyancy areas, each of said pair of front portions connecting its adjacent lateral portion to said central portion, said central portion and said pairs of front and lateral portions forming a simulated W-shape when viewed in a plan view, each of said lateral portions projecting from its front portion a distance sufficient to extend under an adjacent arm of a user and provide a portion of said lateral portion positioned behind said user which together with said rear buoyancy area cause the user to float in a more upright position than when a similar conventional buoyancy device is being used.

Preferably said rear buoyancy area and said pair of lateral portions combine when in use on a user to orient said user at an angle β of between 45 and 90 degrees.

Preferably said buoyancy device further comprises a body encircling belt means and first connecting means for releasably connecting said front buoyancy areas to said to said belt means to hold said front buoyancy areas in position on a user.

Preferably said buoyancy device further comprises second connecting means for releasably connecting said central portion to said to said belt means to hold said rear buoyancy area in position on a user.

Preferably said buoyancy device further comprises third connecting means for releasably connecting adjacent portions of said pair front buoyancy areas together.

Preferably said buoyancy device further comprises a fourth connecting means for releasably connecting said central portion to said to said lateral buoyancy areas to hold said rear buoyancy area to said lateral buoyancy areas.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1:
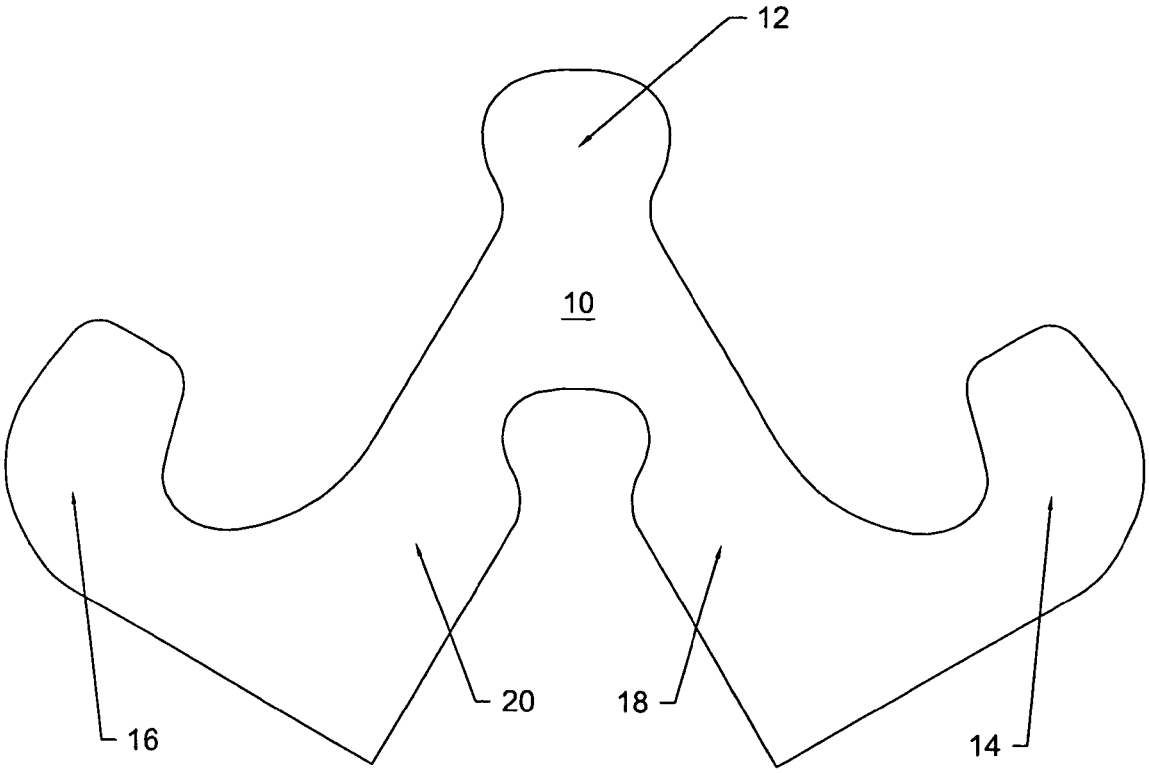
FIG. 1 is a schematic illustration of a deflated bladder for forming a buoyancy chamber having a shape suitable for use in the present invention.
Figure 2A:
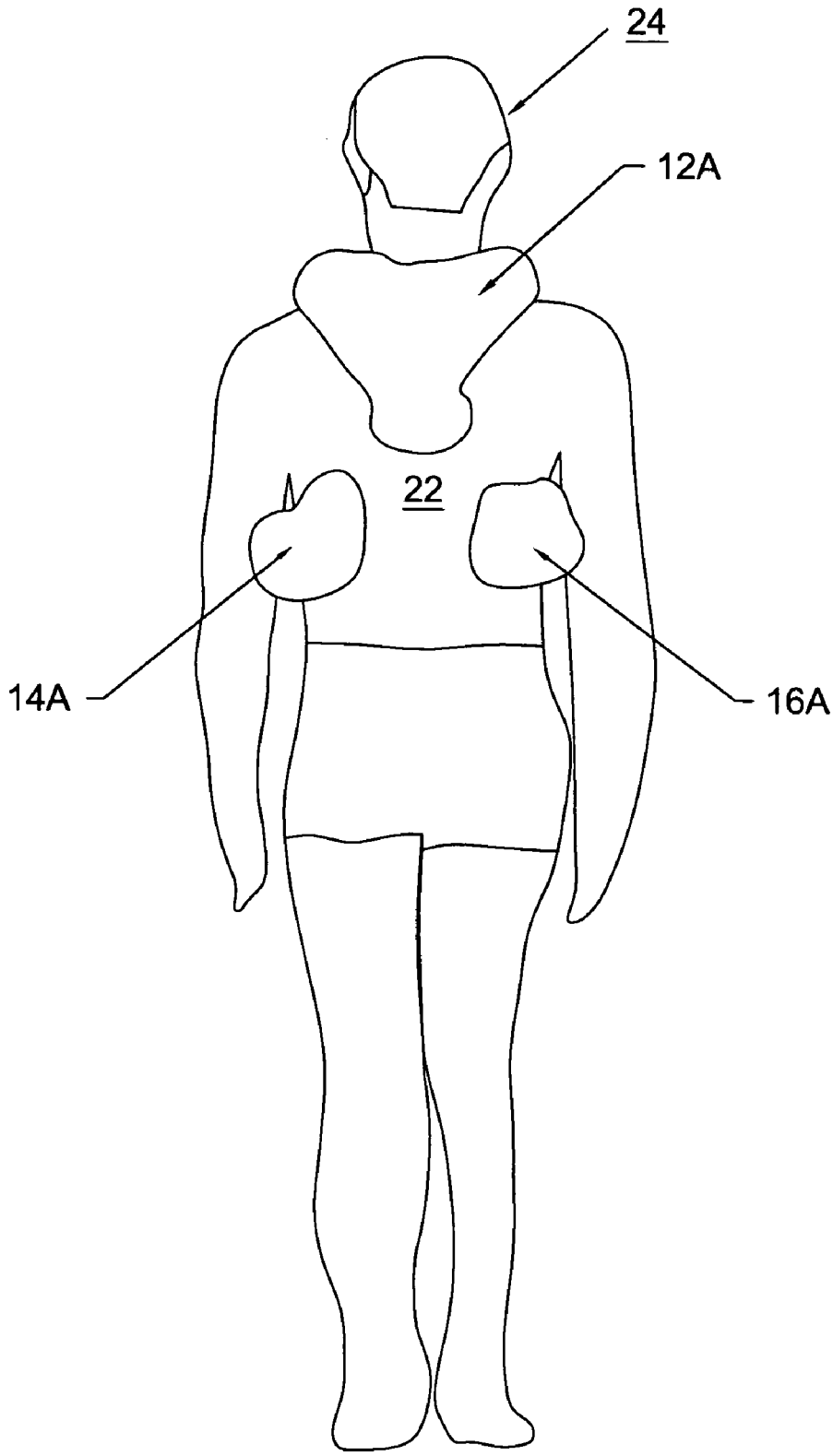
FIG. 2A is a schematic rear view illustrating a buoyancy device configured to incorporate the present invention shown in position on the wearer.
Figure 2B:
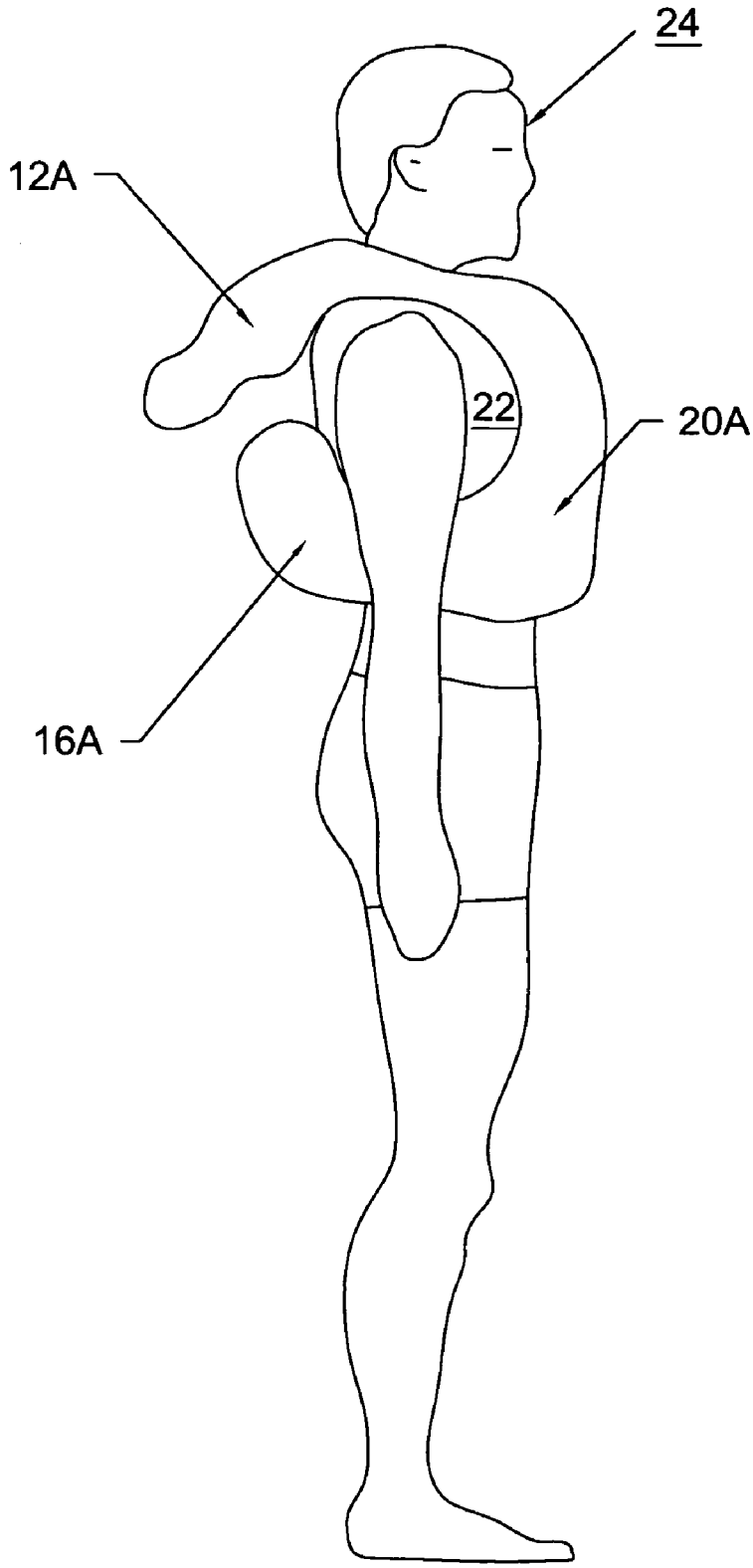
FIG. 2B is a schematic side view illustrating a buoyancy device configured to incorporate the present invention shown in position on the wearer.
Figure 2C:
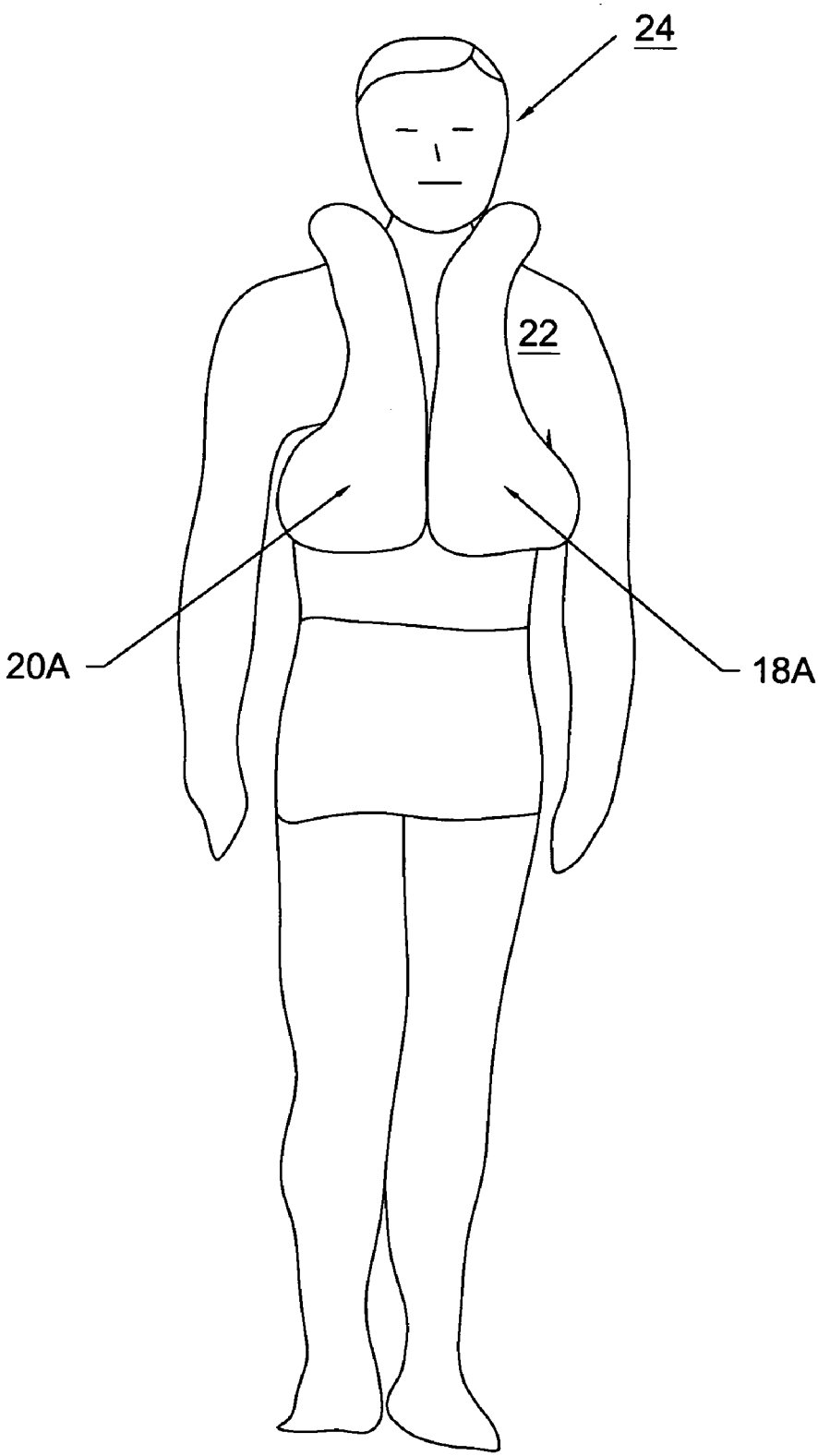
FIG. 2C is a schematic front view illustrating a buoyancy device configured to incorporate the present invention shown in position on the wearer.

Referring to FIG. 1 the basic concept of the present invention is represented by the plan view of the buoyancy device 10 of the present invention, which preferably is formed using an inflatable chamber having one or more compartments (only one shown in the illustration). If desired the device 10 could be formed by buoyant areas made of suitable materials such as for example closed cell foams. The device is composed of a central portion 12 that in use forms a rear buoyancy area 12A (see FIGS. 2A and 2B) and is interconnected to a pair of lateral portions 14 and 16 each forming a lateral (side) or an under arm buoyancy area 14A and 16A respectively (see FIGS. 2A and 2B) by a pair of front portions 18 and 20 which form a pair of front torso buoyancy areas 18A and 20A (see FIGS. 2B and 2C). As is clear from FIG. 1 the portions 12, 14, 16, 18 and 20 are arranged to form a simulated W-shape when viewed in a plan view as illustrated. As is clear from FIGS. 2A, 2B and 2C the device 10 provides buoyancy area positioned around the upper body 22 of the user 24 at the sides front and back. The device 10 will be described in more detail herein below.

Figure 3:
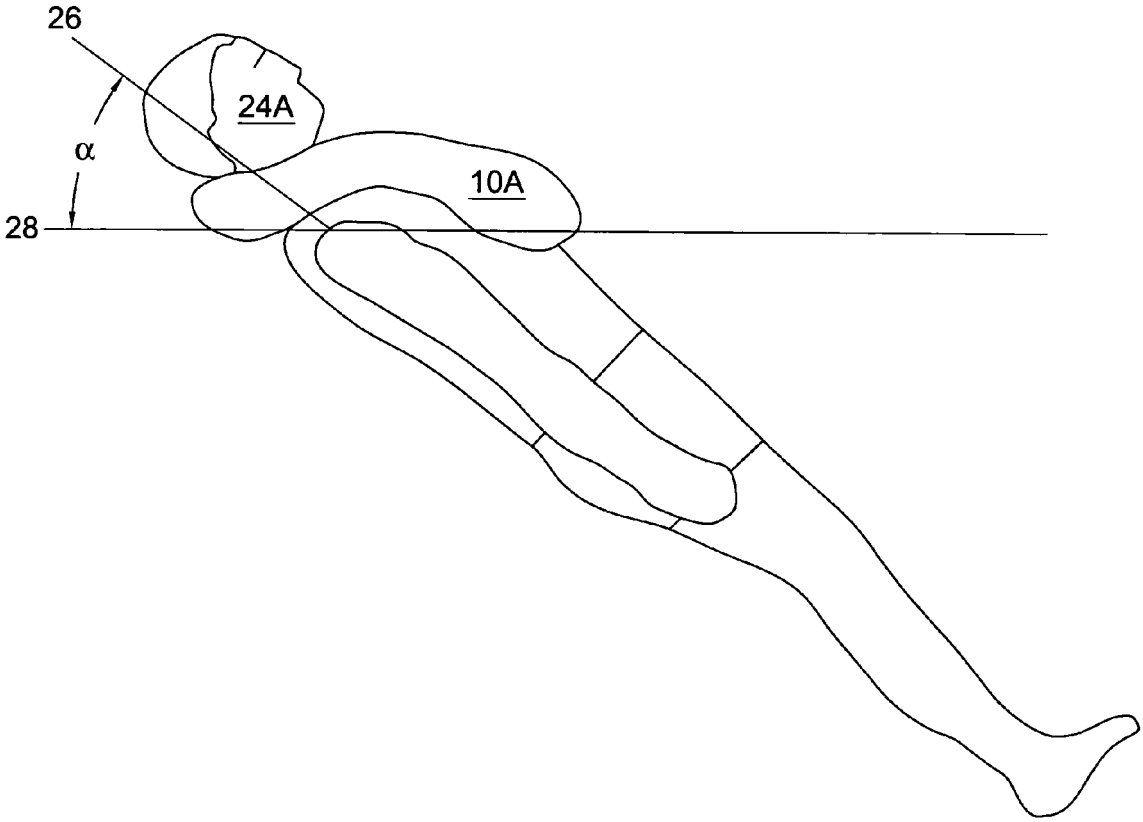
PRIOR ART Fig. 3
FIG. 3 shows the typical floatation attitude of a conventional inflatable device in which the buoyancy primarily has the effect of maintaining the wearer in a stable backwards orientation.
Figure 4:
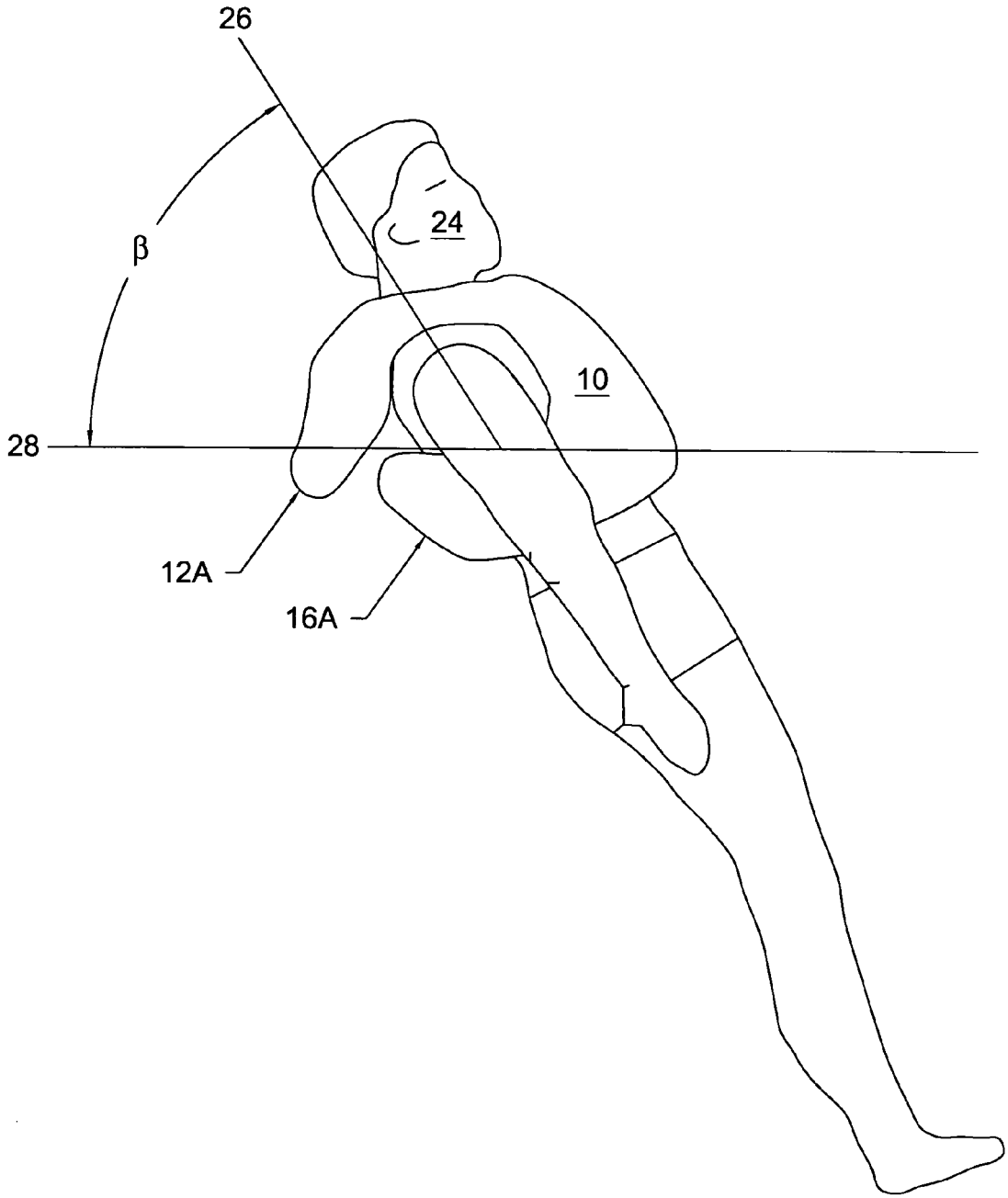
FIG. 4 illustrates how the present invention orients the user in a more upright position and uses some of its buoyancy to support the head and torso higher out of the water.

The effectiveness of the present invention may be seen from a comparison of FIG. 3 (which shows a conventional prior art floatation device 10A) with the FIG. 4 which shows the present invention floatation device 10 in operation. As is apparent the user 24 A stabilizes with the axis of the body as indicated by the axis 26 at and angle α to the surface 28 of the water of about 0° to 45° degrees. Whereas the axis 26 of the user 24 of the present invention stabilizes with its axis 26 at and angle β to the surface 28 of the water of about 45° to 90° degrees. It is apparent that the angle α is considerably smaller than angle β. It is also apparent that the present invention (floatation device 10 in FIG. 4) holds the user significantly higher above the water level. This reorientation and raising of the user 24 higher above the water level 28 is primarily due to the effects of side or lateral buoyancy areas 14A and 16A which as is clearly apparent in use extended under the arms of the user and have a portion at the back of the user (see FIGS. any of 2*a*, 2*b*, 4 and 8) and to a lesser degree by the rear buoyancy area 12A. By making the rear buoyancy area 12A so that it extends farther down the back of the user 24 than the conventional collar structure of the prior art device 10 (FIG. 3) the user is forced into the more upright position shown in FIG. 4.

Turning to FIGS. 5, 6 7 and 8 the construction of the device 10 is more fully illustrated and a suitable system for applying the device 10 of the present invention to a user is shown.

Figure 5:
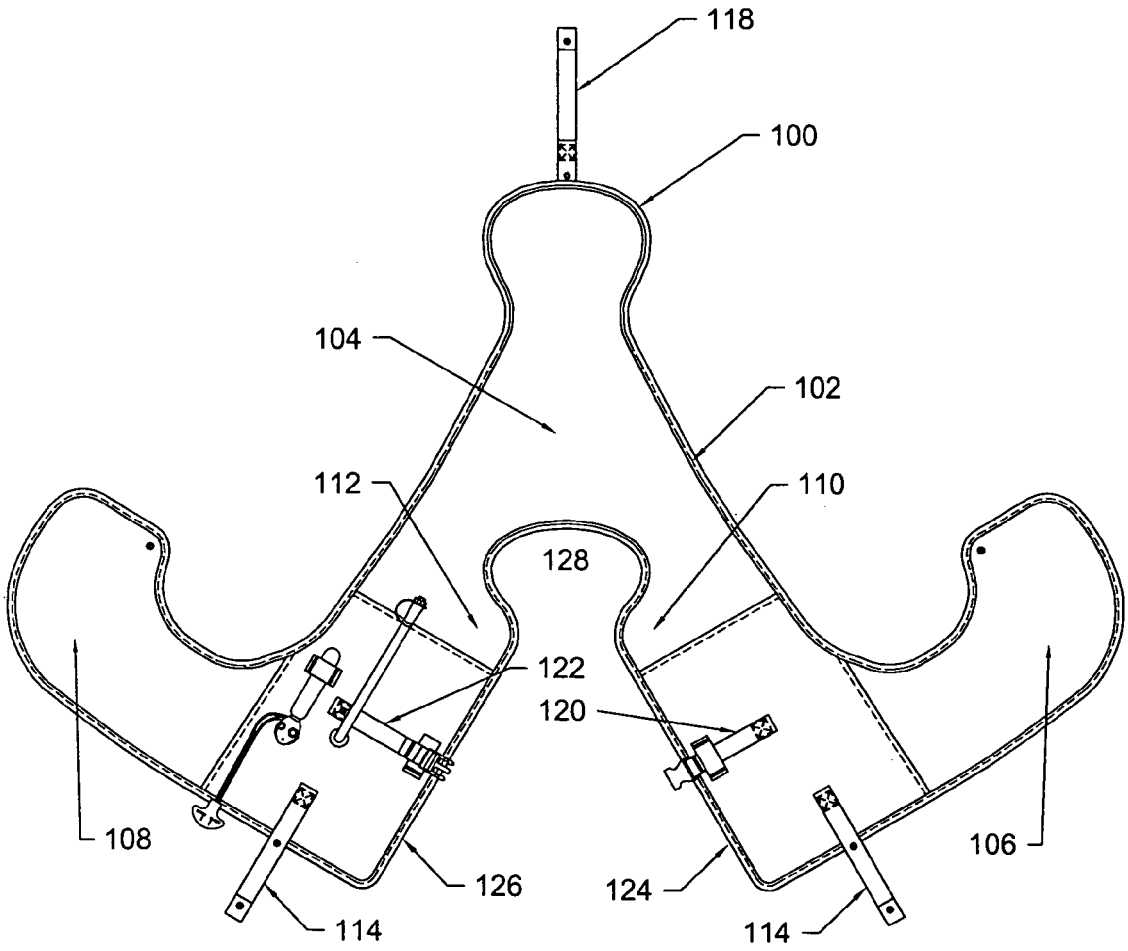
FIG. 5 is a plan view showing the outside of a buoyancy device incorporating the present invention.

As shown in FIG. 5 the outside of the garment structure into which the present invention is incorporated to form the flotation device 10 which preferably is in the form of an inflatable bladder 100 (which has essentially the same shape as the device 10 described above) having a peripheral seam 102 and providing buoyant areas 104, 106, 108, 110 and 112 essentially the same as the portions 12, 14, 16, 18 and 20 described above with respect to the schematic illustration s of FIGS. 1, 2A, 2B, 2C and 4).

Each of the front areas 110 and 112 is provided on its outer surface with a front securing strap 114 that forms a first connecting means for securing its front area 110 or 112 to a belt or other means 116 provided to secure the position of the device 100 (See FIGS. 7 and 8) relative to the user 24. The waist encircling belt or strap 116 of this arrangement is provided with a buckle or the like 115 as a means of adjusting its length.

A second connecting means 118 extends as a rear strap or the like 116 (See FIG. 5) from the rear buoyancy area 104 for securing its rear area 104 to the belt or the like 114 and secure the rear area 104 in position relative to the user 24.

A third connecting means in the form of chest straps is provided on the front of the front areas 110 and 112 is formed by a pair of inter engaging elements or straps 120 and 122 which when coupled together hold the adjacent edges 124 and 126 of the front areas 110 and 112 respectively in close proximity to each other.

To facilitate use and make the garment more comfortable when in use a neck receiving opening 128 is formed adjacent to the top of the front areas 110 and 112 and the top of the back floatation area 104.

When the device is inflatable it will normally be provided with a carbon dioxide ($CO_2$) inflation mechanism 125 or the like and/or an inflation tube 127 that permits inflation by mouth in the event of failure of the $CO_2$ inflation mechanism 125.

Figure 6:
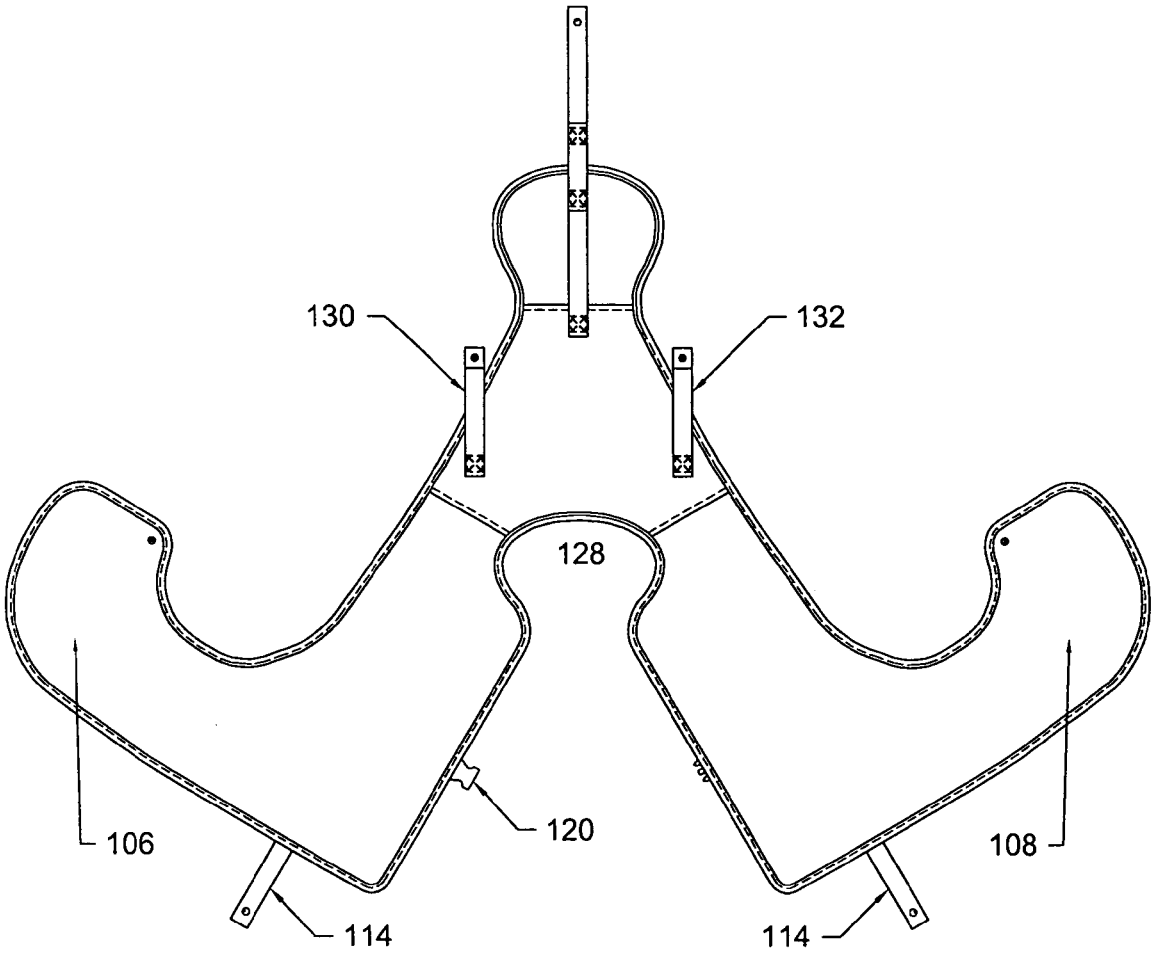
FIG. 6 is a view similar to FIG. 5 but showing the inside of the device.
Figure 7:
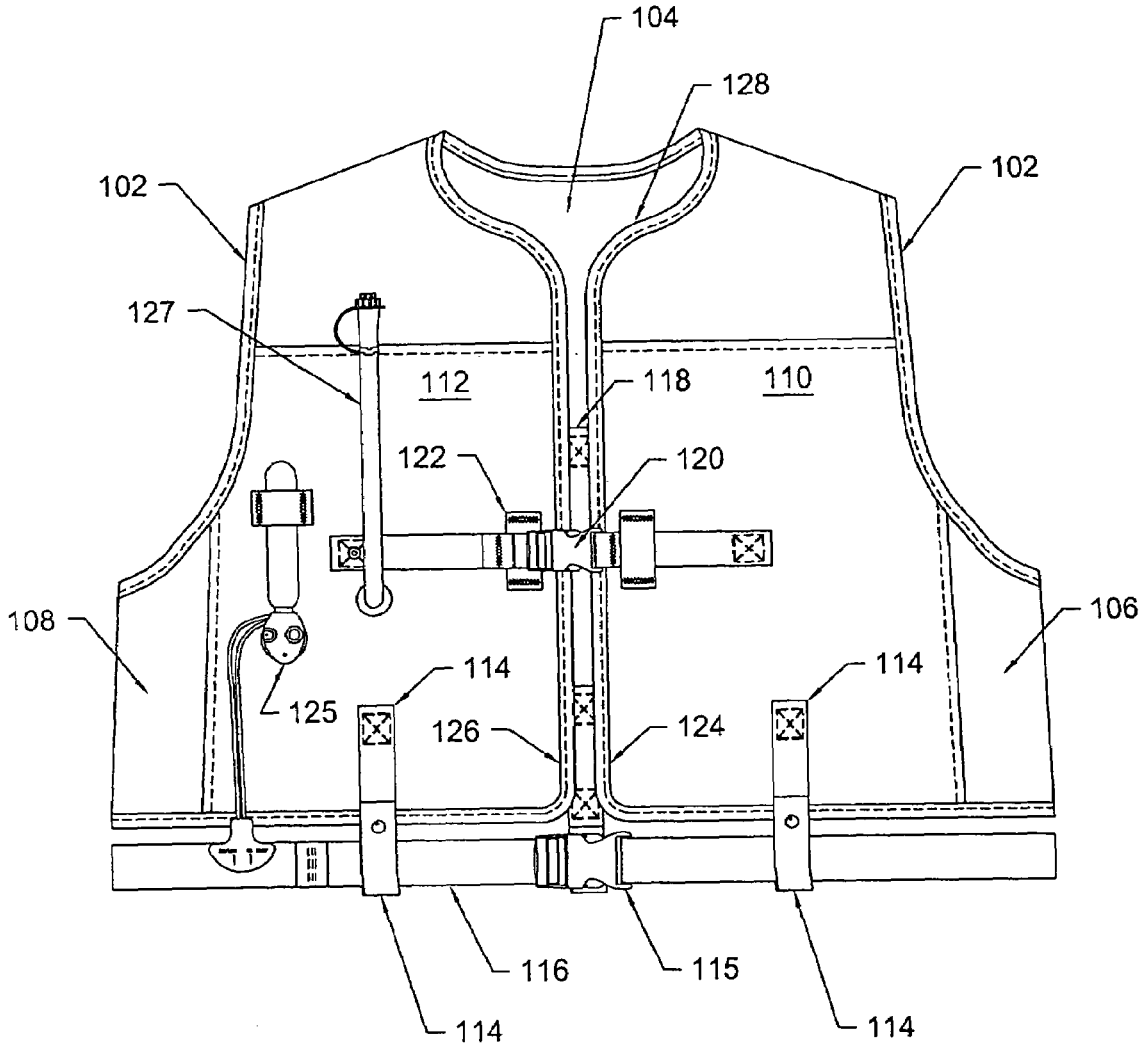
FIG. 7 is a front view of the device of the present invention as it would appear on a user.
Figure 8:
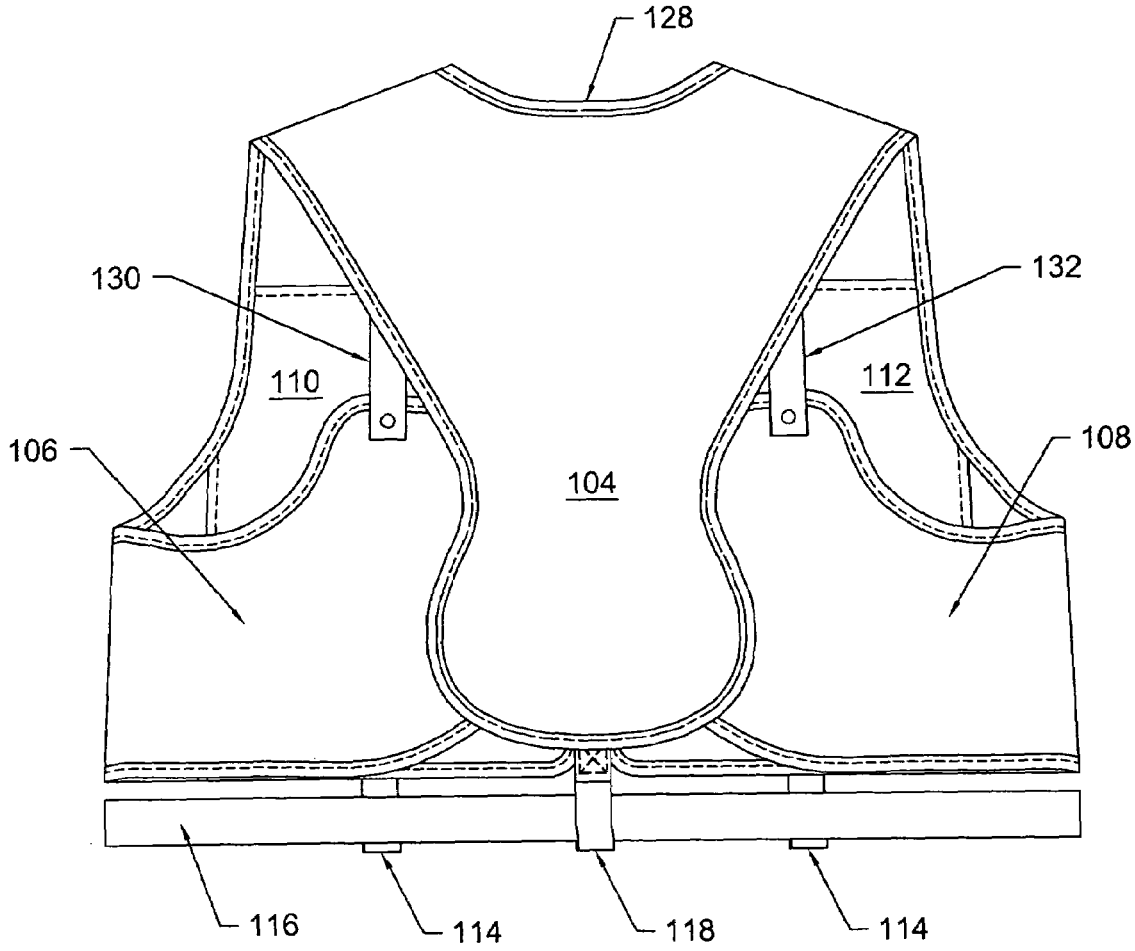
FIG. 8 is a rear view of the device of the present invention as it would appear on a user.

A fourth connecting system is provide by a pair of side straps 130 and 132 located on the rear area symmetrically positioned on opposite sides of and space below the opening 128 (See FIGS. 6 and 8). These straps 130 and 132 cooperate with suitable releasable holding elements e.g. hook and loop fasteners on the straps 130 and 132 and the side areas 106 and 108 to secure the side areas 106 and 108 in position relative to the rear area 104 and the remainder of the floatation device 100.

Because the side areas 106 and 108 are only connected behind the neck, a single size floatation device 100 can readily be adjusted to fit a wide range of torso circumferences.

Having described the invention, modifications will be evident to those skilled in the art without departing from the scope of the invention as defined in the appended claims.

We claim:

1. An inflatable buoyancy device comprising a central inflatable portion for forming when inflated a rear buoyancy area, a pair of inflatable lateral portions each forming when inflated a lateral buoyancy area, and a pair of inflatable front portions forming when inflated front buoyancy areas, each of said pair of front portions connecting its adjacent lateral portion to said central portion, said central portion and said pairs of front and lateral portions forming a simulated W-shape when viewed in a plan view, each of said lateral portions projecting from its front portion a distance sufficient to extend under an adjacent arm of a user and terminating in an end of said W-shape that in operative position on a user will provide a portion of said lateral portion positioned behind said user, a body encircling belt means and first connecting means for releasably connecting said front buoyancy areas to said to said belt means to hold said front buoyancy areas in position on a user and a second connecting means for releasably connecting said central portion to said to said belt means to hold said rear buoyancy area in position on a user, the construction of said lateral portions, said front portions and said central inflatable portion combining to cause said user to float higher above water level than conventional flotation devices and in an upright position at an angle β of between 45 and 90 degrees.

2. A buoyancy device as defined in claim 1 wherein said buoyancy device further comprises third connecting means for releasably connecting adjacent portions of said pair front buoyancy areas together.

3. A buoyancy device as defined in claim 2 wherein said buoyancy device further comprises a fourth connecting means for releasably connecting said central portion to said lateral buoyancy areas to hold said rear buoyancy area to said lateral buoyancy areas.

* * * * *